US005865351A

United States Patent [19]

De Laforcade

[11] Patent Number: 5,865,351

[45] Date of Patent: Feb. 2, 1999

[54] PRESSURIZED DEVICE FOR THE DISPENSING OF LIQUID OF CREAMY PRODUCTS

[75] Inventor: Vincent De Laforcade, Rambouillet, France

[73] Assignee: L'Oreal, Paris, France

[21] Appl. No.: 902,927

[22] Filed: Jul. 30, 1997

[30] Foreign Application Priority Data

Jul. 31, 1996 [FR] France ..... 96 09652

[51] Int. Cl.[6] ..... B65D 83/00

[52] U.S. Cl. ..... 222/402.1; 206/0.7

[58] Field of Search ..... 222/399, 402.1; 206/0.7

[56] References Cited

U.S. PATENT DOCUMENTS 2,689,768 9/1954 Falligant .
3,122,284 2/1964 Miles .
4,729,494 3/1988 Peillon et al. ..... 206/0.7
5,282,549 2/1994 Scholz et al. ..... 222/390

*Primary Examiner*—Philippe Derakshani
*Attorney, Agent, or Firm*—Oblon, Spivak, McClelland, Maier & Neustadt, P.C.

[57] ABSTRACT

A pressurized device for dispensing a product (19) includes a container body having a reservoir cavity (11.1), a valve (12) positioned at the top of the reservoir cavity, a dispenser (14) connected to the valve and a pressurizing device (15). The pressurizing device is formed by an element of cellular material with closed cells. The element of cellular material and the product are placed together inside the reservoir cavity so that the device dispenses the product when the valve is actuated. The element of cellular material has at least one slit at its circumference over its whole height measured along the longitudinal axis of the container body.

21 Claims, 4 Drawing Sheets

PRESSURIZED DEVICE FOR THE DISPENSING OF LIQUID OF CREAMY PRODUCTS

BACKGROUND OF THE INVENTION

1. Field of the Invention

The invention relates to a pressurized device for the dispensing of liquid or creamy products, for example, cosmetic, food or pharmaceutical products. 2. Description of the Related Art A conventional pressurized device is constituted by a container body on which a lid is optionally fitted. A valve is crimped on the neck of the container by means of a valve carrier cup. A dispensing means is connected to the valve. The container body and the cup define a reservoir cavity. The valve is constituted by a valve body, a valve actuating stem that passes through the valve body, a gasket, and a restoring system that applies the valve actuating stem against the gasket, the unit being kept in position by the crimping of the valve carrier cup. The valve actuating stem is surmounted by a push button. A product to be dispensed and a propellant are disposed in the reservoir cavity.

The propellant may be a compressed gas directly in contact with the product in the container body. In this case, a dip tube element is fixed to the valve. When it is not desirable for the product to be in contact with the gas, provision may be also made for separating the gas and the product by a flexible pouch or by a piston. In the case of the flexible pouch, problems frequently arise concerning compatibility with the formula and strength the material constituting the pouch which must be flexible and leakproof In the case where a piston is used for separating the gas from the product, there arise sealing problems along the contact surfaces between the piston and the internal wall of the container body.

Moreover, in these two cases, the fill opening for the gas must be distinct from that for the formula: filling with gas is frequently undertaken through an opening situated at the bottom of the container, obturated by a rubber stopper. This configuration requires repetitive actions during manufacture: opening the gas fill opening, positioning the pouch or the piston, and positioning the stopper. It is also expensive because of the complexity of the filling process: feeding first the product and then the gas.

Moreover, from EP-A-0561292, dispensing devices are known which use as the propellant a cellular material with closed cells. A gas is trapped in the cells of the cellular material. This document describes devices in which the product is placed into a flexible bottle inside the container body. The cellular material is placed into this container body in contact with, and outside, the flexible bottle. The cellular material is connected to a knurled wheel. Before actuating the valve by means of a push button, the user must store energy in the cellular material by actuating the knurled wheel. The gas contained in the cellular material is then subjected to mechanical pressure and transmits this pressure to the bottle and its contents: by actuating the valve, the product can then be dispensed.

However, such a device has several drawbacks: this device has a large number of parts. These parts require very fine adjustment (screw threads, seal) and are sophisticated. As a result, this device is very expensive. The storage of energy by mechanical compression of the cellular material is effected in small quantities: before actuating the push button, the user must turn the knurled wheel to store the energy corresponding to approximately one application dose. The need for this double action renders the device complicated and unattractive for a consumer in a hurry. The bottle wherein the product is contained has the shape of a bellows. Thus, even if it is compressed to a maximum by the action of the cellular material, this bottle cannot be completely emptied and a low recovery rate is obtained.

When the user stores energy in the cellular material by turning the knurled wheel, he creates a strong osmotic pressure on either side of the bottle. Thus the wall of this bottle, subjected to a to and fro motion by the mechanical action of the celular material, becomes fragile by frequent use. With this device, as in the case where a flexible pouch is used for separating a gas from the product, the same problem of compatibility of the product with the wall of the bottle is encountered. Moreover, if the user inadvertently exerts too powerful an action on the knurled wheel, he subjects the cellular material to a pressure which causes the cells containing the gas to burst, and irreversibly damages the device. Finally, such a device does not allow the bottle to be refilled with the product by means of the valve by pressurizing the cellular material since, by this mechanical compression, one would also obtain a bursting of the cells and would thus render the device no longer usable.

SUMMARY OF THE INVENTION

It is an object of the invention to provide a pressurized device which overcomes the aforementioned problems.

It is a further object of the invention to provide a pressurized device using as the propellant an element of a cellular material with closed cells.

In order to achieve the above and other objects, the invention provides a pressurized device for the dispensing of a product, comprising a reservoir cavity; a longitudinal axis; a valve positioned at the top of the reservoir cavity and a dispensing means connected to the valve; and a pressurizing means constituted by an element of closed cell cellular material. The element of cellular material and the product are placed together inside the reservoir cavity and are subjected to a permanent and uniform pressure, so that the device dispenses the product when the valve is actuated. The element of cellular material comprises at least one slit at its circumference over its whole height measured along the longitudinal axis.

In accordance with the invention, the shape of the element of a cellular material is defined before it is introduced into the reservoir cavity.

Although the invention is particularly suitable for a pressurized device wherein the element of a cellular material and the product are subjected to a permanent and uniform pressure, it applies to any type of product dispenser.

"Peripheral" is understood to mean a slit having one end situated at the periphery of the element of a cellular material. A peripheral slit opens the element of the cellular material towards the outside.

The devices in accordance with the invention make it possible to dispense all kinds of products in solution, emulsion or gel form: lotions, creams, self-foaming compositions, milks or gels. Such a device makes it possible to avoid the mixing of gas with the product to be dispensed and to avoid gas leaks. Thus the duration of use of the device is extended. According to the nature of the cellular material and the size of the element of the cellular material, the pressure inside the device can be adapted to the viscosity of the product to be dispensed. Such a device allows a product to be pressurized without the risk of the product being polluted by the gas and without polluting the atmosphere.

Moreover, this device only comprises a small number of conventional mechanical parts and its manufacture is simple. It is therefore inexpensive and simple to use. The device is not fragile and does not involve the risk of the cells bursting due to improper use. Finally, since the compression means is retained inside the device after all of the product has been recovered, it can be refilled and reused several times. Such a device thus makes it possible to obtain a saving in the cost of packaging and permits its eventual reprocessing.

Moreover, a device in accordance with the invention makes it possible to obtain a recovery rate of the product of the order of 95%.

A cellular material usable in the present invention is constituted by a multitude of cells filled with gas enclosed in a deformable matrix such as, for example, a foam of a polyolefin, an elastomer or any type of thermoplastic material; a foam of rubber, Buna, neoprene, silicone or any other material. The gas may be any gas compressible or liquefiable at the usual pressures as, for instance, nitrogen or simply air.

When the cellular material is compressed, the cells are also compressed; they thus store a reserve of energy for pressurizing the product. When the valve of the pressurized device is actuated, the cells expand and the product is restored.

The gas present in the cells is retained therein and cannot escape from them. Thus the problems of leakages and mixing with the product are avoided.

Advantageously, the element of cellular material used as the pressurizing means in the devices in accordance with the invention has a shape complementary to that of the reservoir cavity, and preferably it is chosen to have an overall cylindrical shape.

The element of cellular material can be made in any known way by extrusion or by cutting from a block of cellular material with closed cells. To cut out a cylinder of cellular material, one is obliged to compress it before the cutting. After the cutting and decompression, an element of cellular material is obtained with this method with slightly concave lateral contours, as described in EP-A-0561292. When such an element without a slit at its circumference is positioned in a device such as described above, some of the product will be accommodated between the concavity of the element of the cellular material and the walls of the container. Thus one obtains a recovery rate that is lower than that which can be obtained with a cylinder with perfectly straight contours. However, a cylinder of cellular material cut out from a large-sized block is less expensive than a cylinder of an extruded cellular material. For economic reasons, it is therefore desirable that one should be able to use in the pressurized devices an element of cellular material that is cut out rather than extruded, while retaining a satisfactory recovery rate.

The element of cellular material used in the present invention can be extruded or even cut out. Indeed, the slit permits a wider expansion of the element of cellular material; this expansion compensates the concavity of the cut-out elements of the cellular material. One can thus obtain an almost complete recovery of the product with a cut-out element of cellular material. However, a cut-out element of cellular material has open cells on its contours, while an extruded element has no open cells. An element of cellular material obtained by extrusion is therefore preferable.

Preferably, the element of cellular material has larger dimensions (height, diameter) than those of the reservoir cavity, in such a way that when the reservoir cavity is closed, a precompression of the element of the cellular material is obtained so as to have energy still available when little of the product remains in the device.

In accordance with the invention, the slit is preferably radial relative to the cylinder of the cellular material.

The element of cellular material may optionally have a central opening over its whole height. When the cylinder of cellular material does not have a central opening, the slit is advantageously cut over the whole height of the cylinder of the cellular material and over a width substantially equal to the radius of the cylinder of the cellular material. When a central opening is provided, this may constitute a recess for a dip tube element connected to the valve.

When the device does not have a dip element, it may be advantageous to provide a central opening in the element of cellular material: indeed, on assembly of the device, the element of cellular material is introduced into the reservoir cavity. The element of cellular material usually has a height greater than or equal to the height of the reservoir cavity. When the valve is positioned at the top of the reservoir cavity, for instance when the valve is crimped by means of a valve carrier cup to the top of the container body whose walls define the reservoir cavity, the valve exerts a mechanical compression on the top of the element of cellular material. The cells subjected to the compression burst and the element of cellular material is deformed in its upper portion. Some product may subsequently come to be accommodated in this deformation. Gas is diffused into the reservoir cavity and will mix with the product. To avoid these drawbacks, a central opening may be provided in the element of cellular material into which the valve can be introduced, even when the device does not have a dip tube element.

According to a preferred embodiment of the invention, the slit is associated with a central opening over the whole height of the element of cellular material. The slit is capable of opening the cylinder from its external surface as far as its central opening. It may instead be shallow, that is, not extend as far as the central opening. The element of cellular material has, moreover, a slit extending from its external surface as far as its central opening. Preferably, it has a slit extending from its external surface as far as its central opening. It may have several shallow slits. When the device does not have a dip tube element, the central opening preferably has an elongate shape and is orientated in the extension of the slit.

According to a first variant of the invention, when the device has a dip tube element, the cylinder of cellular material, having a slit which extends from the external surface as far as its central opening, may be constituted by a small piece of cellular material in a rectangular shape which is wrapped round the dip tube element. Indeed, the manufacture of small pieces of cellular material of a rectangular shape is more easily obtained and therefore more economic than that of a cylinder wherein a central opening, and then a slit, are cut out.

The device in accordance with the invention may, in the known way, include a container body defining the reservoir cavity, a valve which comprises a valve body separate from the container body and is positioned at the top of the reservoir cavity, a dispensing means connected to the valve and a pressurizing means constituted by an element of closed cell cellular material, the element of cellular material and the product being placed inside the reservoir cavity and being subjected to a permanent and uniform pressure so that the device dispenses the product when the valve is actuated.

The device in accordance with the invention may be provided with a valve made of an elastomeric material having catch engagement means capable of cooperating with the neck of the container body, as described in the French patent application FR-A-2741933. The valve may be crimped to the neck of the container in the known way by means of a valve carrier cup, the container body and the cup defining the reservoir cavity.

In a second variant of the invention, the device has a cup, a valve provided with a valve body, a valve actuating stem which is optionally surmounted by a push button optionally comprising a dispensing means, a gasket and a restoring system, the cup and the valve body cooperating with each other so as to form a reservoir cavity capable of containing a product to be dispensed and a propellant means, and the valve body proper delimiting the cavity of the valve, a passage being arranged between the reservoir cavity and the cavity of the valve.

According to this variant, the valve body passes through the reservoir cavity over its whole height and forms a dip tube element. The cup and the valve body cooperate in a leakproof manner at their ends so as to form the body of the container. For example, the cup and the valve body have complementary fastening elements, for example, means capable of being catch engaged or complementary profiles which, once assembled, are welded together by any conventional means, for instance, rotational welding or bonding. The fastening elements may also consist of complementary threads, so that the valve body and the cup can be screwed onto one another in a leakproof manner.

To obtain this cooperation, a valve body may be chosen which has on its circumference the fastening elements and a cup having an external skirt that has at its end the fastening elements complementary to those of the valve body, this cooperation defining the body of the can. A cup may also be chosen which has on its circumference fastening elements and a valve body having an external skirt which has fastening elements at its end, complementary to those of the cup. A cup and a valve body may also be chosen which each have an external skirt, the two skirts having complementary fastening elements.

According to this variant, the valve body and the cup cooperate with each other so as to define a cavity inside the container, this cavity delimiting the valve. Preferentially, the valve body, and optionally the cup, each have an internal skirt. Advantageously, the internal skirts of the valve body and the cup are fitted into one another over the whole or part of their height, so as to delimit the cavity of the valve. Preferably, the internal diameter of the internal skirt of the cup is substantially equal to the external diameter of the internal skirt of the valve body. The upper surface of the internal skirt of the valve body advantageously bears on the gasket by applying it against the edge of the cup which surrounds the duct of the valve actuating stem. The seal of the valve is then ensured.

According to this variant, a passage is arranged between the reservoir cavity and the valve. Preferably, the internal skirts of the cup and of the valve body each have at least one notch, these notches being associated with a circular bevel of one or the other of the skirts along the circumference of the contact surface between the skirts, and optionally with a groove over the whole height of the contact surface between the skirts, the set of these cut outs (the groove, bevel, notches) defining the said passage for the product and possibly for the gas between the reservoir cavity and the cavity of the valve.

Advantageously, the valve body and the cup are made of a thermoplastic material. These two elements may be formed from the same material, or from two different chemically compatible materials, so as to allow them to be welded together, or of two chemically incompatible materials joined by screwing, bonding or catch engagement. Of the materials usable in the present invention, there may be mentioned, for example, the family of polyolefins, such as polypropylene, polyethylene and the copolymers of ethylene and of propylene, the family of polyacetals, such as polyoxyethylene; polyethylene terephthalate, methyl polymethacrylate may also be used; the polymer used in the invention may contain fillers such as silica, glass fibers or carbon fibers. The manufacture of these elements in other materials as, for example metal or glass, may be envisaged.

The thickness of the walls of the cup and of the valve carrier and in particular of the skirts, are adapted by the expert so as to withstand the pressure of the propellant means.

The valve actuating stem may be of any known type, for instance, an emergent stem or a female stem, irrespective as to whether they are of an axial displacement or a lateral displacement type, the latter valve type also being termed a "tilt" valve.

The restoring means may, in a known way, be a spring or any compressible or elastically deformable material which can be accommodated in the cavity of the valve.

Optionally, the cup may have a circular groove. The existence of this groove allows a push button of a standard format to be used, which comes to be positioned in the said groove. Moreover, this groove gives the cup greater strength.

The containers according to this variant of the invention are particularly advantageous when they are made in the form of aerosol containers for the sampling of one or more application doses of a product, since they remedy an absence of this type of packaging, satisfying the economic requirements of the market. However, their use is in no way limited to the dispensing of samples: the containers according to this variant of the invention may be obtained in formats of all sizes, in respect of which the expert will know how the nature and the thickness of the material should be adapted, so as to give the container the necessary strength.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1A:
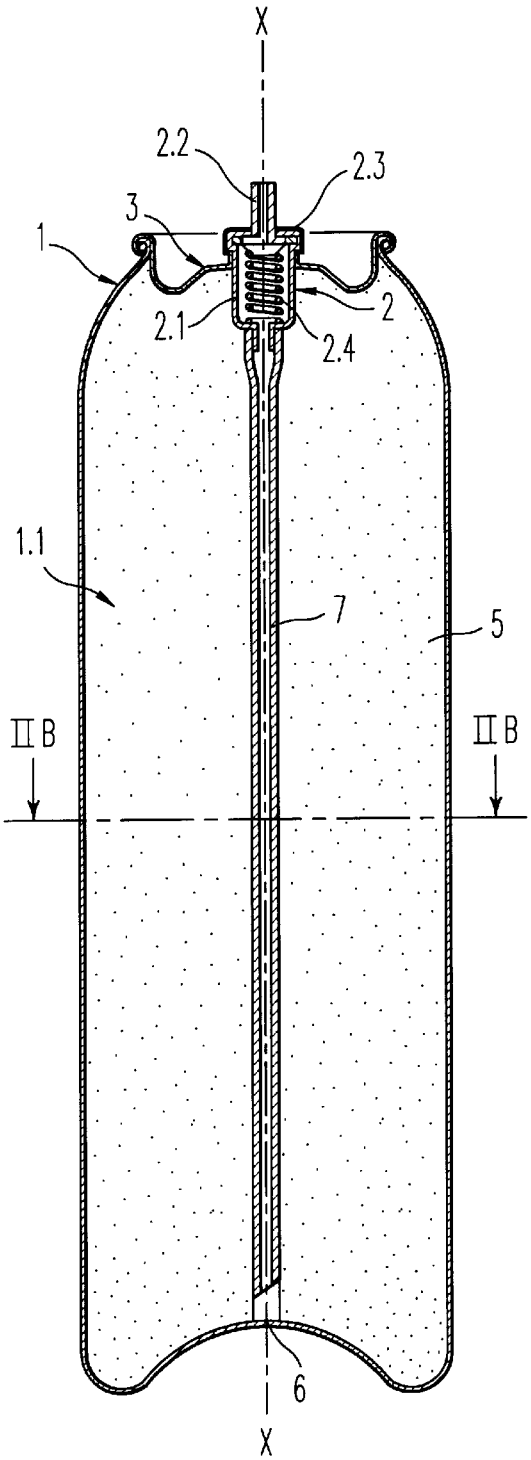
FIGS. 1A and 1B show longitudinal sections of a pressurized device having a cylinder of cellular material with closed cells as the propellant means before and after pressurization, this device being provided with a dip element.
Figure 1B:
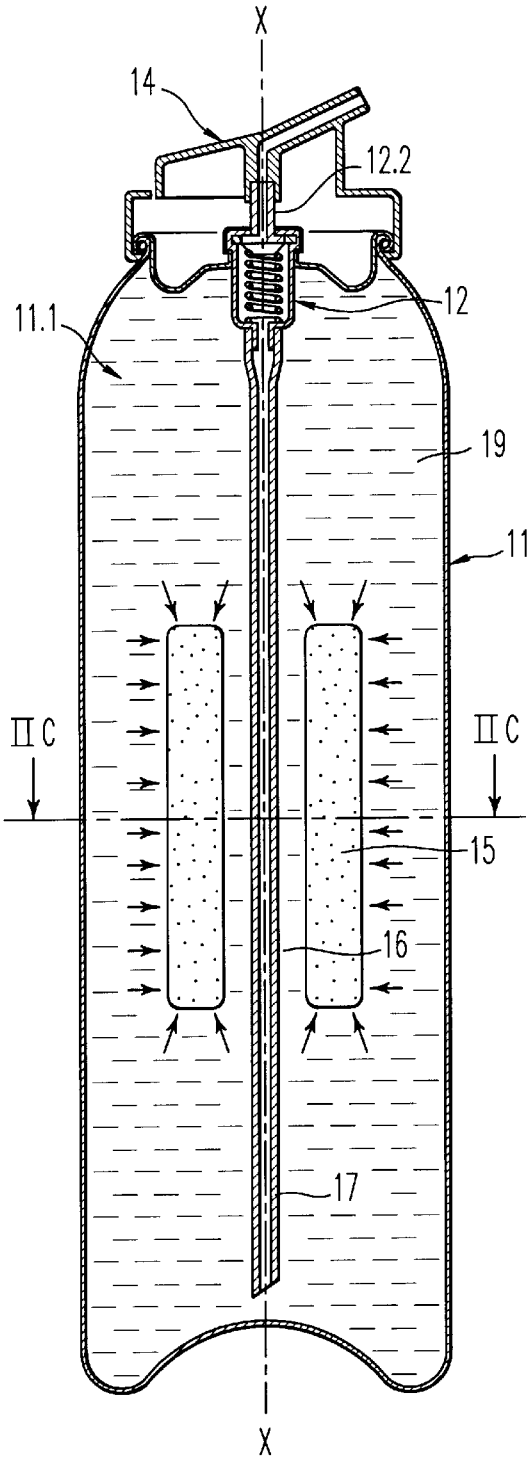

The device shown in FIGS. 1A and 1B has a container body 1 defining a reservoir cavity 1.1 with a longitudinal axis X—X. A lid (not shown) may be optionally fitted on this body. A valve 2 is crimped onto this container by means of a valve carrier cup 3. The valve is formed by a valve body 2.1, a valve actuating stem 2.2 which passes through the valve body, a gasket 2.3 and a spring 2.4 which applies the valve actuating stem 2.2 against the gasket 2.3, the unit being held in position by the crimping of the valve carrier cup 3. A dip tube 7 is fixed to the valve. Before the valve 2 is crimped onto the container body 1, a cylinder 5 of plastazote, namely a matrix of polyolefin and nitrogen, is introduced through the opening of the can.

Figure 2A:
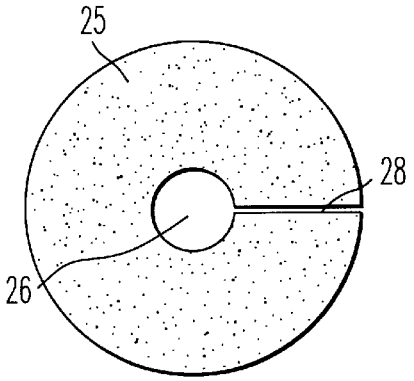
FIGS. 2A and 3A respectively show two embodiments a cylinder of cellular material used in the present invention in cross-section, before being introduced into the reservoir cavity.
Figure 3A:
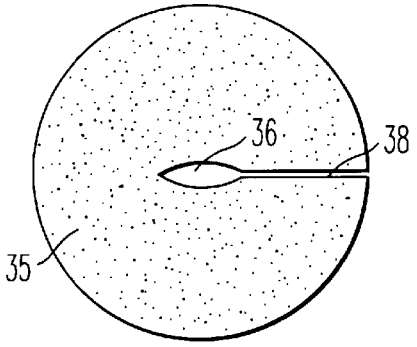

FIG. 2A shows an element 25 of cellular material of a cylindrical shape, having a cylindrical opening 26 at its center and a radial slit 28 which extends from the outer surface of the cylinder as far as the opening 26. This corresponds to the cylinder 5 before it is introduced into the container body 1. FIG. 3A shows an element 35 of cellular material of a cylindrical shape, having an elongate central opening 36 which is substantially eye-shaped, and a slit 38 in the extension of the opening 36. This element may be used instead of the cylinder 25 in a device without a dip element.

Figure 2B:
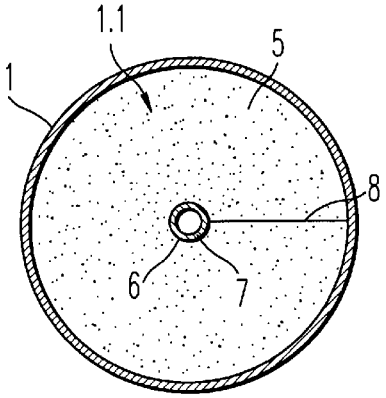
FIGS. 2B and 3B respectively show the two embodiments of FIGS. 2A and 3A installed in a container and correspond to section IIB—IIB of FIG. 1A.

In FIG. 2B, the cylinder 5 of cellular material with closed cells has been introduced into the container body 1. The outer diameter of the cylinder 5 is greater than the diameter of the reservoir cavity 1.1, so as to obtain a lateral precompression of the cellular material and produce sufficient energy for dispensing the dregs of the product. The dip tube 7 passes through a central cylindrical opening 6 in the cylinder 5.

The elements of FIG. 1B in common with FIG. 1A have the reference numerals of FIG. 1A increased by 10. The elements of FIG. 2C in common with FIG. 2B have the reference numerals of FIG. 2B increased by 10.

Figure 2C:
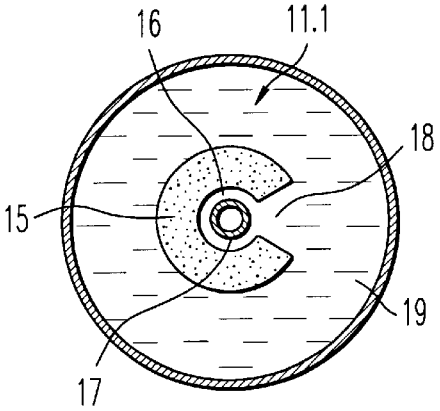
FIGS. 2C and 3C respectively show the two embodiments of FIGS. 2A and 3A installed in a pressurized container and correspond to section IIC—IIC of FIG. 1B.

A device in accordance with the invention ready for use has been shown in FIGS. 1B and 2C. This device is distinguished from that shown in FIGS. 1A and 2B in that a product 19 has been introduced with force by means of the valve 12, which results in a lateral and longitudinal compression of the cylinder 15 of the cellular material. The compression is of the hydraulic type, that is to say, in three dimensions over the volume of the element 15 of cellular material. The internal diameter of the opening 16 is then slightly increased as compared with the diameter of the opening 6 shown in FIG. 1A, the edges of the slit 8 shown in FIG. 2B have diverged so as to form an opening 18. The cylinder 15 of cellular material is thus free for displacement along the dip tube 17 according to its relative density as compared with the product.

A push button 14 is positioned on the valve actuating stem 12.2. By actuating the push button 14, the valve 12 is opened, the cylinder 15 is dilated and ejects the product 19. When all the product 19 has been ejected from the device, the latter is again in the state shown in FIGS. 1A and 2B. Thanks to the slit, the cylinder consisting of cellular material is considerably expanded and the formation of zones retaining the product is avoided. This device can then be recharged with the product 19, as has been described above. Thus a saving is obtained in packaging and the problem of reprocessing pressurized devices is considerably reduced, since the same device can be reused many times.

Figure 3B:
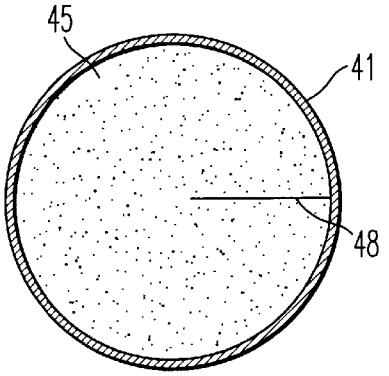
Figure 3C:
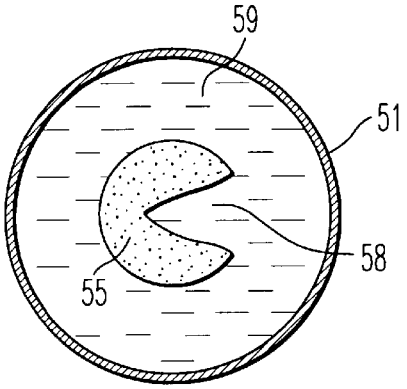

The variant of the device in accordance with the invention shown in FIGS. 3A, 3B and 3C is distinguished from the device shown in FIGS. 1A, 1B and 2A, 2B and 2C by the absence of the dip tube in the cylinder of cellular material. However, this cylinder has an elongate, substantially eye-shaped central opening 36 and a slit 38 in the extension of this opening. In FIG. 3B, there is seen the cylinder 45 of cellular material which is positioned in the container 41. Then in FIG. 3C, the same cylinder 55 will be seen in hydraulic compression in the container 51 into which the product 59 has been introduced.

Figure 4A:
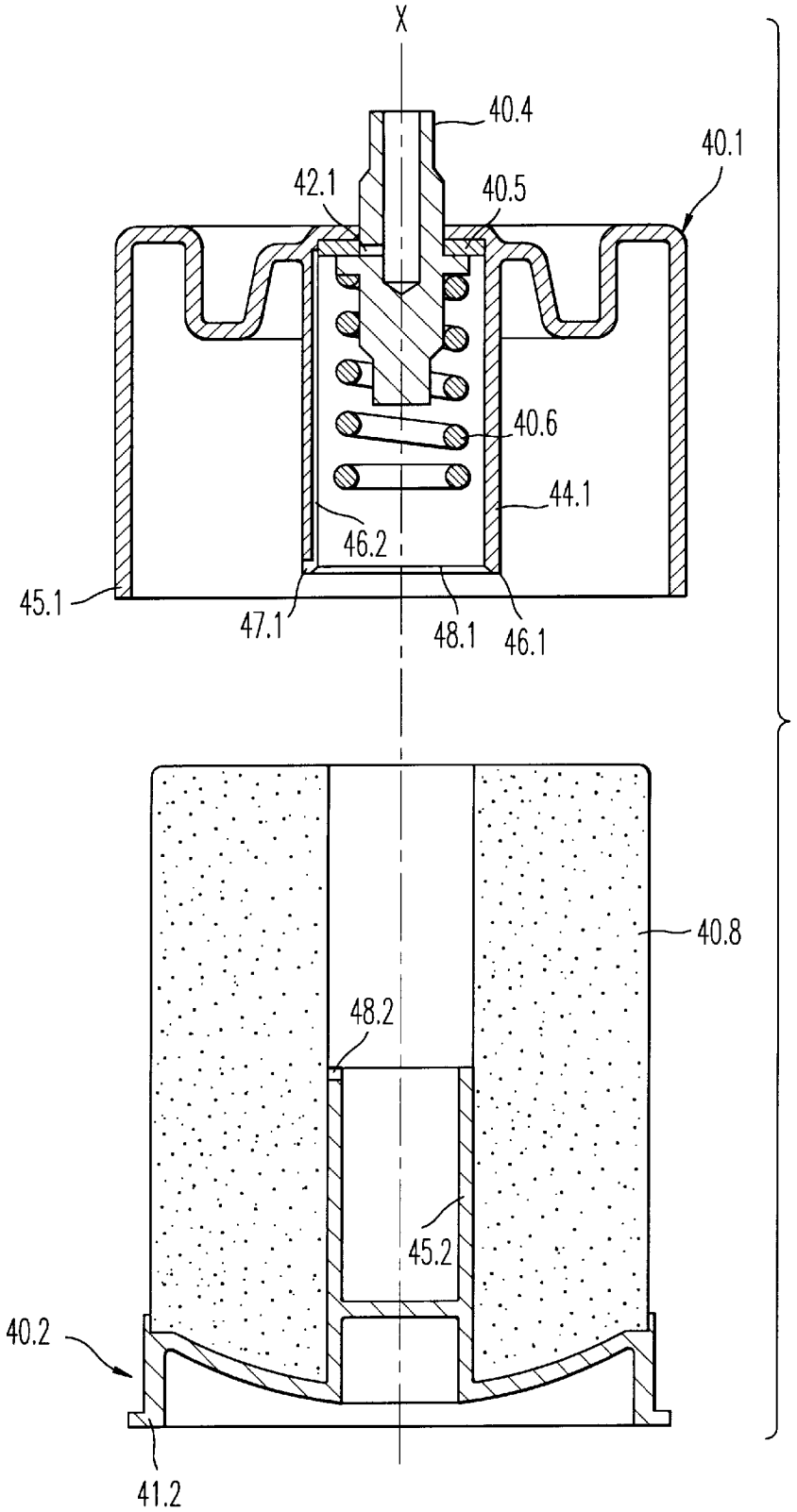
FIGS. 4A, 4B and 4C respectively show a device according to a variant of the invention in a longitudinal section in the course of being assembled.
Figure 4B:
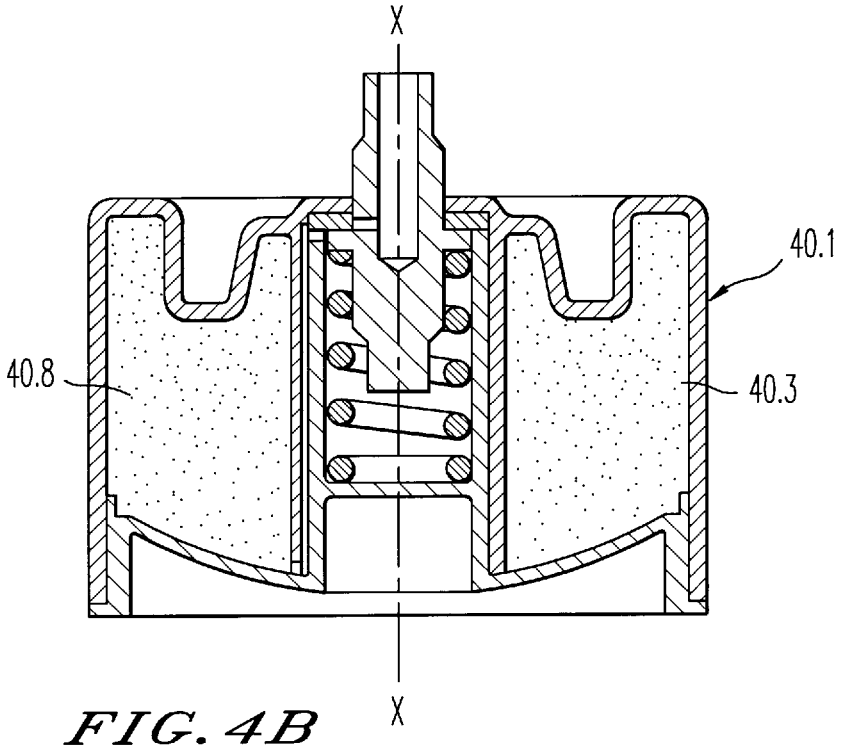
Figure 4C:
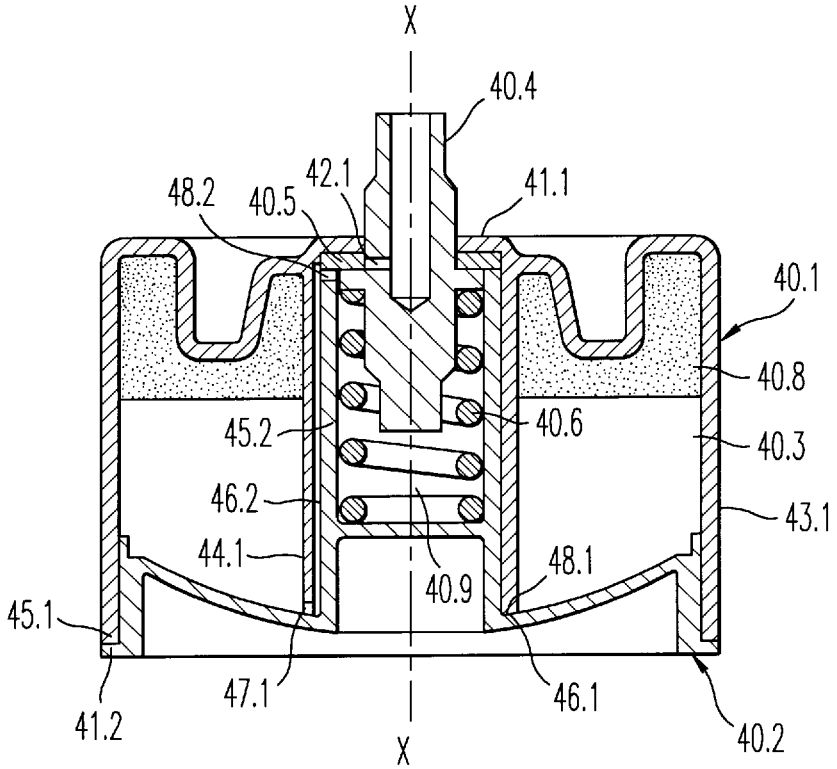

A pressurized container according to FIGS. 4A to 4C of a generally cylindrical shape consists of a cup 40.1 whereon there may be fitted a lid (not shown). This cup cooperates with the valve body 40.2 so as to form both an annular reservoir cavity 40.3 with a longitudinal axis X—X, containing a product 40.7 and into which a ring 40.8 of cellular material, such as shown in FIG. 2A, has been introduced, and the cavity of the valve 40.9. Inside this cavity, there are disposed an emergent valve actuating stem 40.4, a gasket 40.5 and a spring 40.6 which, together with the valve body, constitute the valve proper. The emergent stem 40.4 is intended to cooperate with a push button, not shown.

At the center of its upper plate 41.1, the cup 40.1 has moreover an opening 42.1 through which the emergent stem 40.4 passes, an external skirt 43.1 and an internal skirt 44.1 which are coaxial, the plate 41.1 having a substantially perpendicular orientation to these skirts.

In its bottom portion, the external skirt 43.1 has a profile 45.1 capable of receiving a complementary profile 41.2 integral with the valve body 40.2 of the valve; these two profiles are welded (FIG. 4C).

The internal skirt 44.1 of the cup has an internal diameter substantially corresponding to that of the gasket 40.5 and a height substantially identical with that of the cavity 40.3. The bottom surface 46.1 of the internal skirt of the cup is welded to the bottom of the valve body (FIG. 4C). A bevel 48.1 is situated on the internal circumference of the skirt 44.1. A notch 47.1 is, moreover, provided in the bottom internal circumference of the skirt 44.1. This notch interrupts the continuity of the weld between the internal skirt and the valve body.

The valve body 40.2 has on its circumference a profile 41.2 complementary to that 45.1 already described. This profile allows the valve body and the cup to be centered during assembly and is welded to the portion 45.1 of the cup. The valve body has an internal skirt 45.2 whose external diameter is substantially equal to the internal diameter of the internal skirt 44.1 of the cup, and these two elements are welded together. A groove 46.2 is provided on the external side face of this skirt 45.2 over its whole height, and on the upper edge of this groove is situated a notch 48.2.

The assembly of the pressurized container of FIG. 4C is shown in FIGS. 4A and 4B. First, the spring 40.6 is assembled around the emergent stem 40.4, then the gasket 40.5 is fitted in the space defined by the internal skirt of the valve body. Then the ring 40.8 and the cup 40.1 are positioned and the cup is welded to the valve body 40.2 at the end of the skirts.

The pressurized container is then filled through the valve. By pressing on the emergent stem 40.4, the pressurized product fills the first cavity 40.9 defined by the internal skirt of the valve body, passes through the notch 48.2, descends along the groove 46.2 through the bevel 48.1, then through the notch 47.1 and fills the cavity 40.3.

A push button and a lid, not shown, can then be mounted on the emergent stem and on the cup respectively.

When the emergent stem is depressed by means of the push button, the product follows the reverse path to that described for the filling of the device.

On injection of the product, the ring 40.8 is still compressed. When the product arrives through the openings 47.1 situated at the bottom of the cavity 40.3, the ring is pushed back towards the top. It follows therefrom that the container thus constituted functions in a multipositional mode. If the product passes during the filling towards the upper portion of the cavity by compressing the ring, and even by pushing it back towards the bottom, this does not change the functioning since, thanks to the slit in the ring 40.8, the ring is capable of completely expanding and pushing all the product towards the valve.

In a device whose element of cellular material would not have a slit, a recovery rate of the order of 60% would be obtained. On the other hand, the devices in accordance with the invention shown above make it possible to obtain a recovery rate of the product in excess of 90%.

Obviously, numerous modifications and variations of the present invention are possible in light of the above teachings. It is therefore to be understood that the invention may be practiced otherwise than as specifically described herein.

What is claimed is:

1. A pressurized device for dispensing a product, comprising:

a container body having a reservoir cavity;

a valve positioned at an end of the reservoir cavity;

a dispensing member connected to the valve; and an element of closed cell cellular material positioned together with the product inside the reservoir cavity and having at least one slit extending to the periphery of the element and extending over the entire height of the element as measured along the longitudinal axis of the reservoir cavity.

2. A device according to claim 1, wherein the element of cellular material and the product are in a pressurized state in the reservoir cavity.

3. A device according to claim 1 wherein the element is formed of a cellular material chosen from a foam of polyolefin, of an elastomer, of a thermoplastic material, of rubber, of Buna, of neoprene or of silicone.

4. A device according to claim 1 wherein the element has a shape complementary to that of the reservoir cavity.

5. A device according to claim 1 wherein the element has an overall cylindrical shape.

6. A device according to claim 5, wherein the slit is radial relative to the cylindrical shape.

7. A device according to claim 6 wherein the slit extends over a width substantially equal to the radius of the cylindrical cellular material.

8. A device according to claim 1 wherein the element is an extruded part.

9. A device according to claim 1 wherein the element has at least one dimension greater than those of the reservoir cavity before it is positioned in the reservoir cavity.

10. A device according to claim 1 wherein the element has a central opening over the entire height of the element.

11. A device according to claim 10, wherein the slit extends from the peripheral surface of the element to the central opening.

12. A device according to claim 10 wherein the central opening is cylindrical.

13. A device according to claim 1 including a dip tube element in the reservoir cavity.

14. A device according to claim 13 wherein the cylinder is comprised by a rectangular piece of cellular material wrapped round the dip tube element.

15. A device according to claim 10 wherein the central opening has an elongate shape and is orientated at an extension of the slit.

16. A device according to claim 1 wherein the valve comprises a valve body separate from the container body.

17. A device according to claim 16 wherein the valve is crimped onto the neck of the container by a valve carrier cup, the container body and the cup defining the reservoir cavity.

18. A device according to claim 16 wherein the valve is made of an elastomeric material having catch engagement means for cooperating with the neck of the container body.

19. A device according to claim 1 wherein the container body comprises a cup and the valve comprises a valve body defining a valve cavity, a valve actuating stem fittable in the valve cavity via a gasket, and a restoring system biasing the valve actuating stem out of the valve cavity, wherein the cup and the valve body cooperate with each other so as to form the reservoir cavity and the valve, further comprising a passage connecting the reservoir cavity and the valve cavity.

20. A device according to claim 1 wherein the product is chosen from any kind of solution, emulsion or gel.

21. A device according to claim 1 wherein the product is chosen from lotions, creams, self-foaming compositions, milks or gels.

* * * * *

UNITED STATES PATENT AND TRADEMARK OFFICE

CERTIFICATE OF CORRECTION

PATENT NO. : 5,865,351

DATED : February 2, 1999

INVENTOR(S): Vincent DE LAFORCADE

It is certified that an error appears in the above-identified patent and that said Letters Patent is hereby corrected as shown below:

On the title page, and on top of column 1, the title should be:

--[54] PRESSURIZED DEVICE FOR THE DISPENSING OF LIQUID OR CREAMY PRODUCTS--

Signed and Sealed this

Tenth Day of August, 1999

*Attest:*

*Attesting Officer*

Q. TODD DICKINSON

*Acting Commissioner of Patents and Trademarks*